US009462898B1

(12) United States Patent
Finnell

(10) Patent No.: US 9,462,898 B1
(45) Date of Patent: Oct. 11, 2016

(54) FOLDABLE FRAME ASSEMBLIES AND RELATED METHODS

(71) Applicant: William G. Finnell, DeBary, FL (US)

(72) Inventor: William G. Finnell, DeBary, FL (US)

( * ) Notice: Subject to any disclaimer, the term of this patent is extended or adjusted under 35 U.S.C. 154(b) by 0 days.

(21) Appl. No.: 14/877,396

(22) Filed: Oct. 7, 2015

Related U.S. Application Data

(60) Provisional application No. 62/060,906, filed on Oct. 7, 2014.

(51) Int. Cl.
*A47G 1/06* (2006.01)
*B31D 5/00* (2006.01)
*A47G 1/14* (2006.01)

(52) U.S. Cl.
CPC ..... *A47G 1/0633* (2013.01); *A47G 1/141* (2013.01); *B31D 5/00* (2013.01)

(58) Field of Classification Search
CPC ..... G09F 1/04; G09F 1/06; A47G 1/0633; A47G 1/141
See application file for complete search history.

(56) References Cited

U.S. PATENT DOCUMENTS 1,528,361 A * 3/1925 Bashwiner ..... G09F 1/06 40/788
2,203,578 A 6/1940 Podmore
2,203,737 A 6/1940 Moore
2,634,531 A 4/1953 Fielding
2,814,896 A 12/1957 Fujikawa
3,214,855 A 11/1965 Winkler et al.
3,286,387 A * 11/1966 Poertner ..... A47G 1/0633 40/788
3,394,479 A 7/1968 Siegler
4,738,041 A * 4/1988 Drueck, Jr. ..... G09F 15/00 248/524
4,870,766 A 10/1989 Topping
5,359,794 A * 11/1994 Wood ..... G09F 1/12 40/789
6,163,991 A 12/2000 Drapcho et al.
2005/0183308 A1 8/2005 Peery
2012/0297653 A1* 11/2012 Ridless ..... A47G 1/141 40/773

* cited by examiner

*Primary Examiner* — Cassandra Davis
(74) *Attorney, Agent, or Firm* — Allen Dyer Doppelt Milbrath & Gilchrist

(57) ABSTRACT

A foldable frame assembly includes an integral sheet having a central area surrounded by opposed pairs of foldable frame areas. The foldable frame areas each include a first section, a second section, and a third section. The integral sheet includes a plurality of lines of weakness that delineate a boundary of the central area, the first sections, the second sections, and the third sections. The foldable frame areas are folded along respective lines of weakness such that the first sections form forward-facing frame front walls, and the second sections form inward-facing side front walls. The third sections extend under the second sections and abut the first sections, and secured to the central area. The first sections form acute angles with both the second sections and the third sections.

17 Claims, 5 Drawing Sheets

FOLDABLE FRAME ASSEMBLIES AND RELATED METHODS

CROSS-REFERENCE TO RELATED APPLICATION

This application claims the benefit of U.S. Provisional Patent Application Ser. No. 62/060,906, filed on Oct. 7, 2014, the contents of which application are herein incorporated by reference in their entirety.

FIELD OF THE INVENTION

The present invention relates to prints and printmaking, and more particularly, to the framing of prints and to the making of frames for prints and other items for display.

BACKGROUND OF THE INVENTION

Foldable frame or display assemblies are known in the art. However, such frame assemblies tend to employ various tabs or other connectors that result in an unsatisfactory appearance, or lack the rigidity necessary for use with larger prints. Further improvement is possible to produce a foldable frame that is easy to assemble and aesthetically attractive, and retains its folded position without attachment tabs.

SUMMARY OF THE INVENTION

Based on the foregoing, it is an object of the present invention to provide an improved print and frame assembly, and related methods of use and manufacture. According to an embodiment of the present invention, a foldable frame assembly includes an integral sheet having a central area surrounded by opposed pairs of foldable frame areas. The foldable frame areas each include a first section, a second section, and a third section. The integral sheet includes a plurality of lines of weakness that delineate a boundary of the central area, the first sections, the second sections, and the third sections. The foldable frame areas are folded along respective lines of weakness such that the first sections form forward-facing frame front walls, and the second sections form inward-facing side front walls. The third sections extend under the second sections and abut the first sections, and secured to the central area. The first sections form acute angles with both the second sections and the third sections.

According to another embodiment of the invention, a method for folding the foldable frame assembly comprises folding along lines of weakness between the center area and the first sections, folding along lines of weakness between the first sections and the second sections such that the first sections form forward-facing frame front walls of the frame assembly, folding along lines of weakness between the second sections and the third sections such that the second sections form inward-facing frame sidewalls of the frame assembly. The third sections are extended under the second sections and abut the first sections, and secured to the central area, such that the first sections form acute angles with both the second sections and the third sections.

These and other objects, aspects and advantages of the present invention will be better appreciated in view of the drawings and following detailed description of preferred embodiments.

DETAILED DESCRIPTION OF A PREFERRED EMBODIMENT

Figure 1:
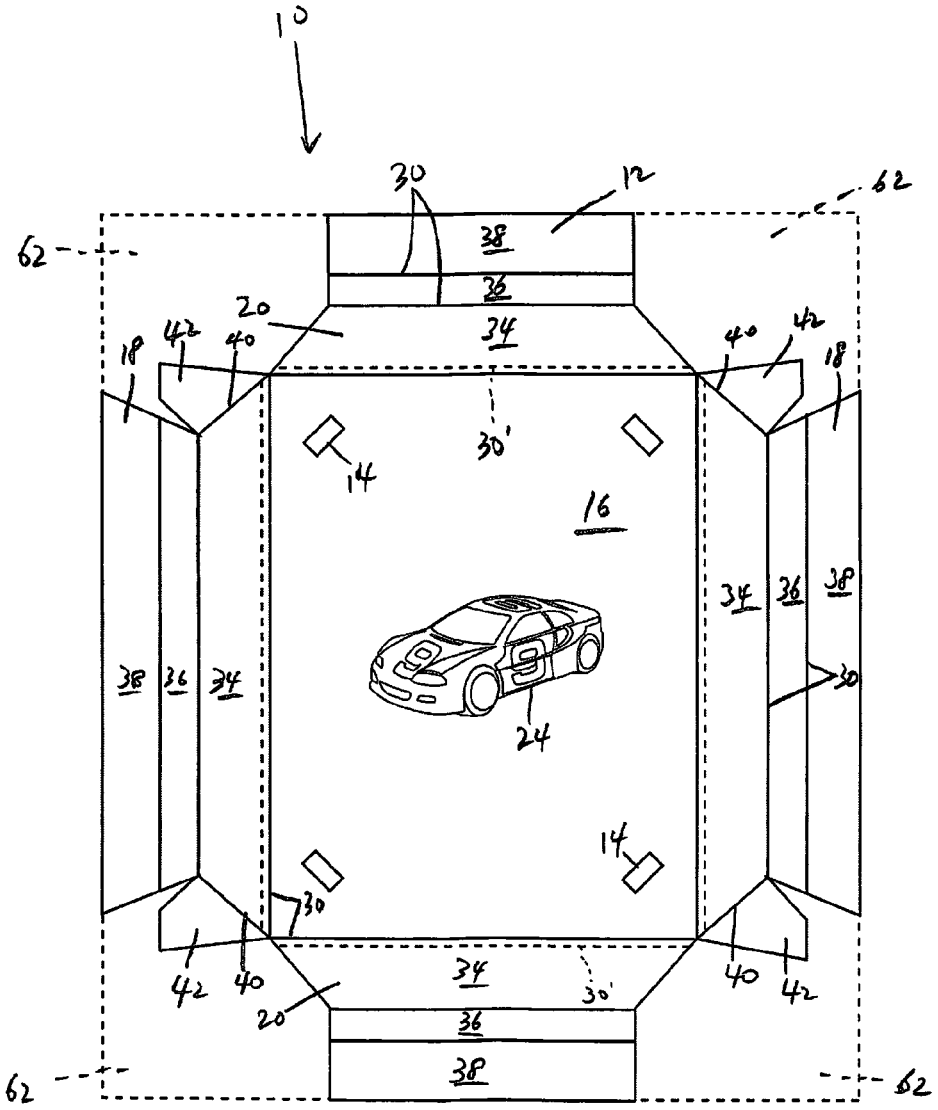
FIG. 1 is a front view of a foldable frame assembly, according to an embodiment of the present invention.

According to an embodiment of the present invention, referring to FIG. 1, a foldable frame assembly 10 includes an integral sheet 12 having a central area 16 surrounded by opposed pairs of foldable frame areas 18, 20. A plurality of lines of weakness 30 are defined in the sheet 12. The lines of weakness 30 delineate a boundary of the central area 16, and the first, second and third sections 34, 36, 38 of the foldable frame areas 18, 20. The lines of weakness 30 facilitate the formation of folds between adjacent areas and sections.

In one embodiment, adhesive elements 14, such as pressure sensitive adhesive strips, are arranged on the sheet 12. The adhesive elements 14 are located on a surface of the third sections 38 and/or four corners of the central area 16.

Figure 2:
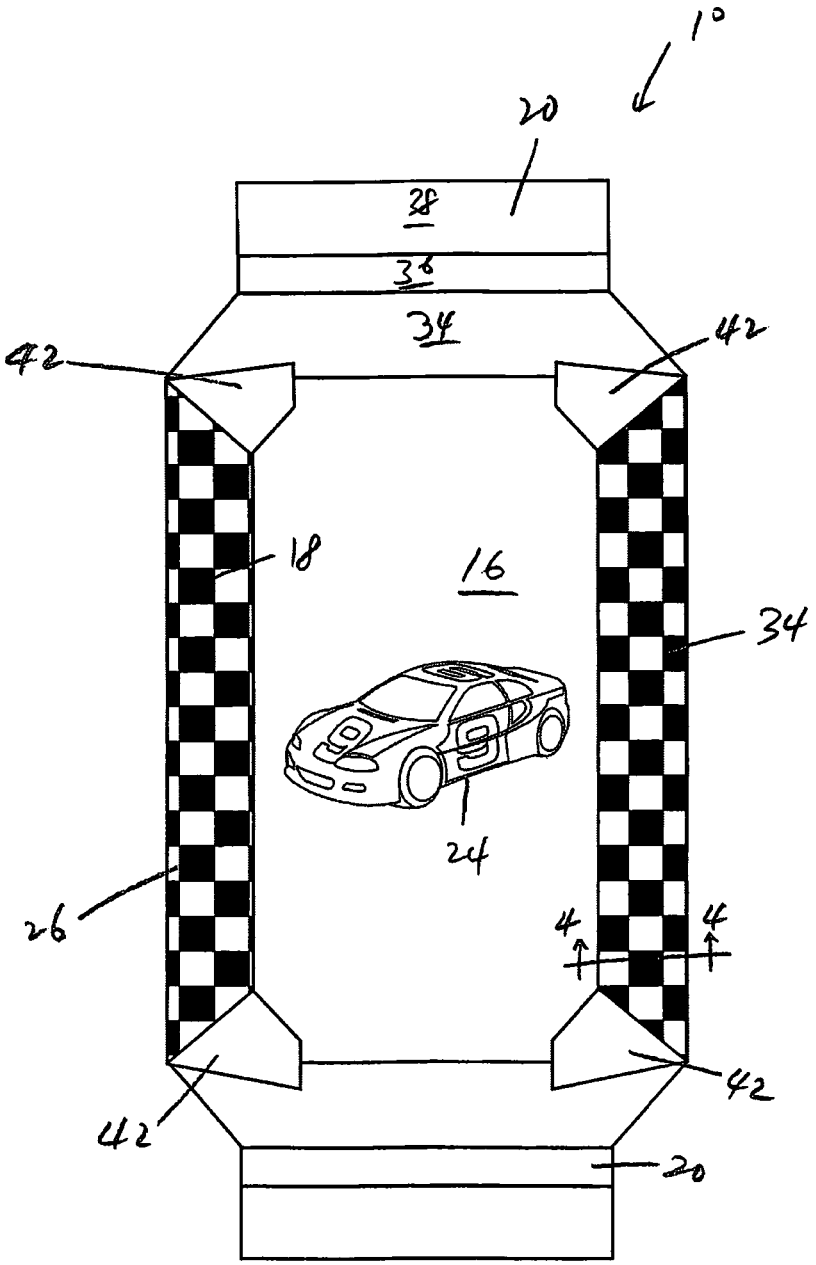
FIG. 2 is a front view of the assembly of FIG. 1, in a partially folded configuration.
Figure 3:
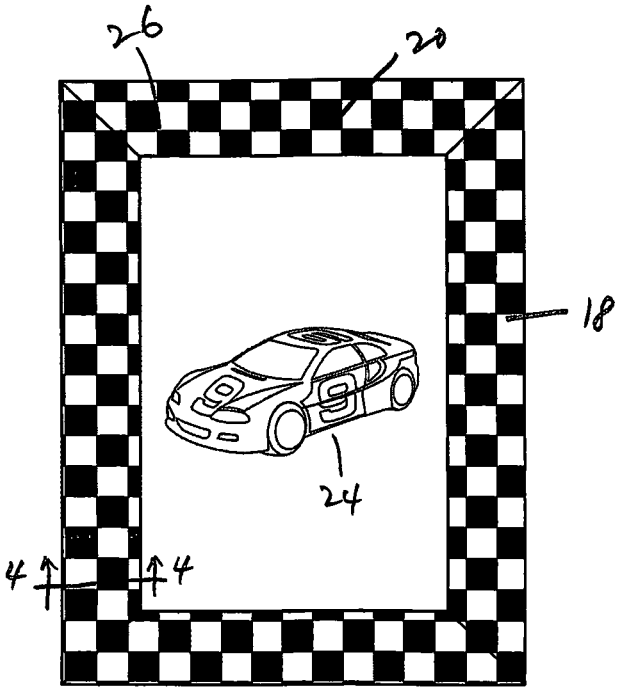
FIG. 3 is a front view of the assembly of FIG. 1, in a fully folded configuration.

Referring to FIGS. 2 and 3, an image 24 is located on the central area 16 of the sheet. A frame design 26 can be located on reverse surfaces of portions of the frame areas 18, 20. The image 24 and design 26 are preferably printed onto the sheet 12, as will be described in greater detail below. It will be appreciated that the present invention is not necessarily limited to a particular image 24 or design 26. For example, the design 26 could also be a solid color.

With reference to FIGS. 1-4, prior to use, the assembly 10 can advantageously be shipped to a retail point of sale, or other destination, in the substantially flat state of FIG. 1. When the assembly 10 is purchased, or otherwise desired to be displayed, the foldable frame areas 18 are each folded along their respective lines of weakness 30 into the configuration of FIG. 4, with the third sections 38 secured to the central area 16 by the adhesive elements 14. The foldable frame areas 20 are subsequently folded into the FIG. 4 configuration along their respective lines of weakness 30, and the third sections 38 are secured to the central area 16 by the adhesive elements 14 (FIG. 3).

It will be appreciated from the foregoing that the assembly 10 allows quick easy formation of a "framed" print, without the difficulty or expense of conventional framing. Additionally, the entire assembly 10 is formed on the sheet 12, allowing easy and inexpensive shipping prior to frame formation, if desired.

Figure 4:
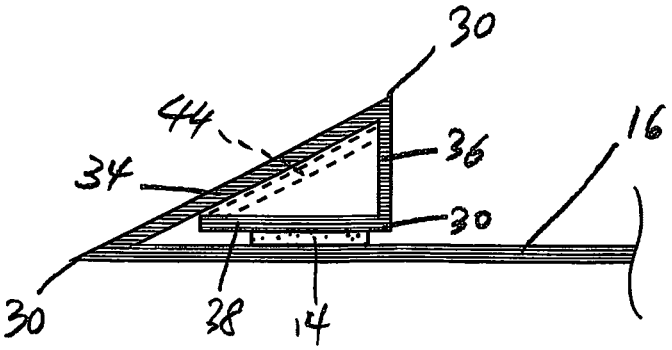
FIG. 4 is a sectional view taken along lines 4-4 of FIG. 3.

Referring particularly to FIG. 4, an acute angle between each first section 34 and the central area 16 is preferred, although other angles can also be selected. In the depicted embodiment, free ends of the first sections 34 are chamfered to align when folded. In each corner of the first section of foldable frame area 18, one of the lines of weakness 40 also defines a corner tab 42 on the foldable frame area 18 depending from the first section 34.

Additionally, referring to FIGS. 1-3, the free ends of the second sections 36 of the foldable frame areas 20 are preferably parallel, while the free ends of the second sections 36 of the foldable frame areas 18 are chamfered. This creates a gap free, mitered appearance with the foldable frame areas 20 folded partially over the foldable frame areas 18, and can also increase the rigidity of the assembly 10.

Referring again to FIG. 4, the third sections 38 of the foldable frame areas 18, 20 are preferably dimensioned to extend far enough to abut the first sections 34 when folded. This helps ensure consistent folding and can further increase the rigidity of the assembly 10. To further increase strength and rigidity, fourth sections 44 could be added beyond the third sections 38, which would lay parallel with the first sections 34 and abut the second sections 36.

The corner tab 42 is also folded relative to the first section 34 such that the corner tab rests along the line of weakness 30 between the central area 16 and the foldable frame area 20 and abuts the second section 36 of the foldable frame area 20. The first section 34 abuts the corner tab 42 at each end and the second section 36 being folded over each corner tab 42. As a result, the rigidity of the corners is increased by the corner tabs 42. Also, the corner tabs 42 can enhance the aesthetic appearance of the corners by eliminating any visible gaps between adjacent first sections 34.

Referring again to FIG. 1, to allow variations in frame dimensions, one or more alternate lines of weakness 30' can also be defined in the sheet 12. A key or other instructions can be provided, or printed onto, the sheet 12, to explain which lines of weakness 30, 30' are used to achieve various dimensions. Additionally, the assembly 10 could also be manufactured in different sizes.

Figure 5:
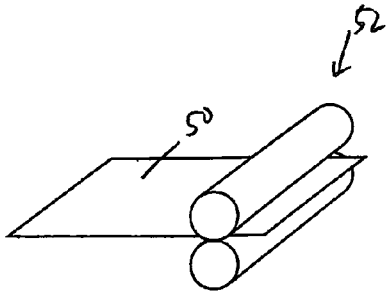
FIG. 5 is a schematic perspective view of a printing step in the manufacture of the assembly of FIG. 1.
Figure 6:
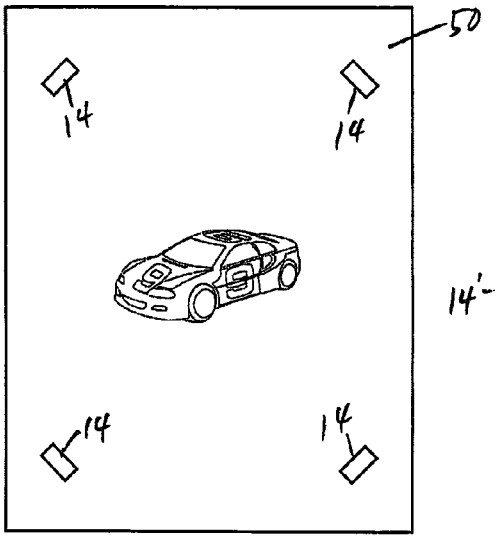
FIG. 6 is a front view of the assembly of FIG. 1, in a pre-finished state.
Figure 7:
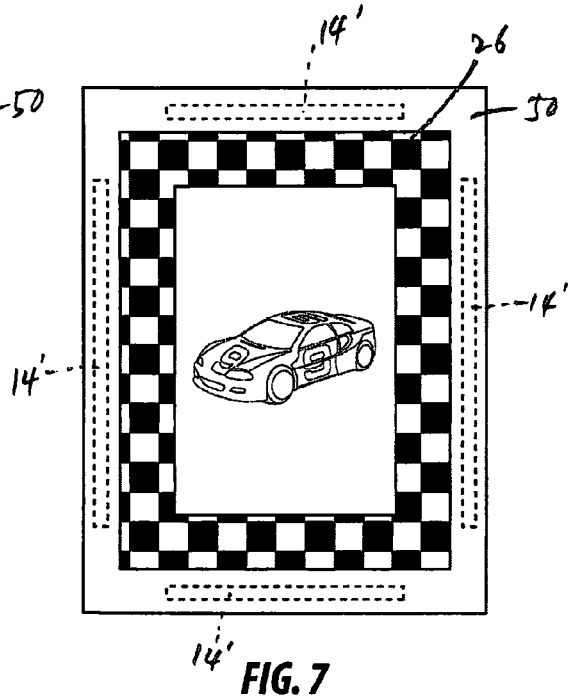
FIG. 7 is a rear view of the assembly of FIG. 1, in the pre-finished state.
Figure 8:
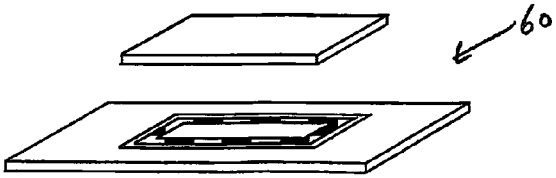
FIG. 8 is a schematic view of a die-cutting step in the manufacture of the assembly of FIG. 1.

Referring to FIGS. 1 and 5-8, according to an aspect of the present invention, manufacture of the assembly 10 begins by passing sheet stock 50 through double-sided printing apparatus 52 (FIG. 5). The printing apparatus 52 prints the image 24 and frame design 26 onto opposite sides of the sheet 12 (FIGS. 6 and 7). It will be appreciated that a multi-step printing process could also be used. Additionally, the image 24 and/or design 26 could be printed on separate materials that are subsequently laminated or otherwise adhered to the stock 50.

The adhesive elements 14 are applied to the printed stock 50. Elements 14' (FIG. 7) show alternate application locations for adhesive elements. The adhesive elements 14 or 14' can be applied at any convenient time during the manufacturing process.

The printed stock 50 is placed in a die assembly 60. The die assembly 60 forms the lines of weakness 30, 30' and removes corners 62 from the printed stock (FIG. 1). Alternately, the corners 62 could be weakened for removal at a later time.

Figure 9:
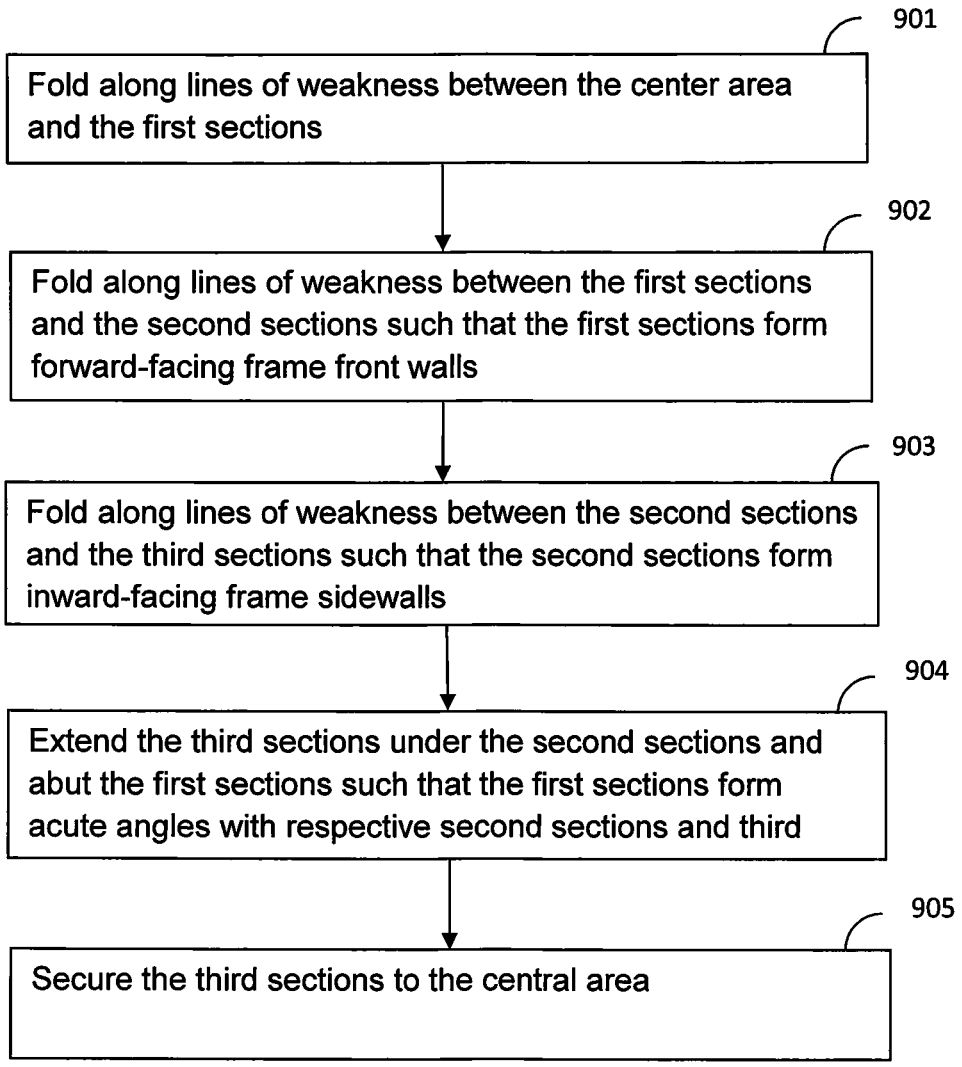
FIG. 9 is a flowchart of an example method of folding the assembly of FIG. 1.

Referring to FIG. 9, at step 901, the sheet 12 is folded along lines of weakness between the center area 16 and the first sections 34. At step 902, the sheet 12 is folded along lines of weakness between the first sections 34 and the second sections 36 such that the first sections 34 form forward-facing frame front walls. At step 903, the sheet 12 is folded along lines of weakness between the second sections 36 and the third sections 38 such that the second sections 36 form inward-facing frame sidewalls. At step 904, the third sections 38 are extended under the second sections 36 and abut the first sections such that the second sections 36 form acute angles with respective first sections 34 and third sections 38. At step 905, the third sections 38 are secured to the central area 16, for example, by adhesive elements 14.

In one embodiment, the sheet 12 further includes a fourth section 44, the sheet can be further folded along lines of weakness between the third sections 38 and the fourth sections 44 such that the fourth sections 44 lay parallel with the first sections and abut the second sections.

In another embodiment, the sheet 12 further includes a plurality of corner tabs 42 extends from the first sections 34, the plurality of corner tabs 42 are folded relative to the first sections such that the corner tabs rests along the line of weakness between the central area 16 and abuts the second sections 36.

It will be appreciated that present invention allows relatively quick and easy formation of the assembly 10. Thus, a combined print and frame assembly can be produced and sold with only marginally greater time and expense than producing a print, alone.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A foldable frame assembly comprises:

an integral sheet having a central area surrounded by opposed pairs of foldable frame areas, the foldable frame areas each comprises a first section, a second section, and a third section; and a plurality of lines of weakness in the integral sheet that delineate a boundary of the central area, the first sections, the second sections, and the third sections;

wherein the opposed pairs of the foldable frame areas are each folded along respective lines of weakness toward the central area, such that the first sections form forward-facing frame sidewalls, and the second sections form inward-facing frame front walls, the third sections extend under the second sections and abut the first sections, and is secured to the central area, such that the first sections form acute angles with both the second sections and the third sections;

wherein each foldable frame area further includes a fourth section separated by an additional line of weakness from the third section, the fourth sections being folded along the additional lines of weakness such that the fourth sections extend from the third sections under and parallel with the first sections to abut the second sections.

2. The foldable frame assembly of claim 1, wherein the third sections are secured to the central area by adhesive elements.

3. The foldable frame assembly of claim 2, wherein the adhesive element includes pressure sensitive adhesive strips.

4. The assembly of claim 2, wherein the adhesive elements are located on a surface of the third sections.

5. The assembly of claim 2, wherein the adhesive elements are located on four corners of the central area.

6. The assembly of claim 1, wherein the plurality of lines of weakness are creases and perforations.

7. The assembly of claim 1, wherein free ends of the first sections are chamfered to align.

8. The assembly of claim 1, wherein the first, second and third sections are folded such that the second section is approximately perpendicular to the central area.

9. The assembly of claim 1, wherein each foldable frame area further includes a corner tab depending from the respective first sections.

10. The foldable frame assembly of claim 1, wherein an image is printed on the central area of the sheet.

11. The foldable frame assembly of claim 1, wherein a frame design is printed on reverse surface of portions of the foldable frame areas.

12. The foldable frame assembly of claim 1, wherein the first sections and the central area form acute angles.

13. A method for folding the assembly of claim 1, the method comprising:

folding along lines of weakness between the center area and the first sections;

folding along lines of weakness between the first sections and the second sections such that the first sections form forward-facing frame front walls;

folding along lines of weakness between the second sections and the third sections such that the second sections form inward-facing frame sidewalls;

extending the third sections under the second sections and abut the first sections such that the first sections form acute angles with respective second sections and third sections; and securing the third sections to the central area the method further comprises folding along lines of weakness between the third sections and the fourth sections such that the fourth sections lay parallel with the first sections and abut the second sections.

14. The method of claim 13, wherein the third sections are secured to the central area by the adhesive elements.

15. The method of claim 13, wherein folding along lines of weakness between the second sections and the third sections such that the second sections are approximately perpendicular to the central area.

16. The method of claim 13, wherein folding along lines of weakness between the second sections and the third sections comprises extending the third sections and abutting the first sections.

17. The method of claim 13, wherein each foldable frame areas further includes corner tabs depending from the respective first sections, the method further comprising folding the plurality of corner tabs relative to the first sections such that the corner tabs rests along the line of weakness between the central area and the foldable frame area and abuts the second section.

* * * * *